US007225587B2

(12) United States Patent
Shinehouse et al.

(10) Patent No.: US 7,225,587 B2
(45) Date of Patent: Jun. 5, 2007

(54) COVER SYSTEM FOR SEPTIC TANK

(75) Inventors: Scott E. Shinehouse, Henderson, MN (US); J. William Shinehouse, Belle Plaine, MN (US)

(73) Assignee: Belle Plaine Block and Tile, Inc., Belle Plaine, MN (US)

( * ) Notice: Subject to any disclaimer, the term of this patent is extended or adjusted under 35 U.S.C. 154(b) by 163 days.

(21) Appl. No.: 10/898,791

(22) Filed: Jul. 26, 2004

(65) Prior Publication Data

US 2006/0016132 A1 Jan. 26, 2006

(51) Int. Cl.
*E04D 29/14* (2006.01)

(52) U.S. Cl. ..... 52/19; 52/20; 52/21; 52/4; 52/247; 52/80.1

(58) Field of Classification Search ..... 52/19–26, 52/3, 4, 245, 247, 246, 249, 80.1, 80.2–80.6, 52/82–89; 404/25–26
See application file for complete search history.

(56) References Cited

U.S. PATENT DOCUMENTS

| | | | | | |
|---|---|---|---|---|---|
| 3,974,500 | A * | 8/1976 | Goldfischer | 342/113 |
| 4,368,600 | A * | 1/1983 | Carriere | 52/11 |
| 4,469,467 | A * | 9/1984 | Odill et al. | 404/25 |
| 4,475,845 | A * | 10/1984 | Odill et al. | 404/25 |
| 4,593,714 | A | 6/1986 | Madden | |
| 4,662,777 | A | 5/1987 | Newton | |
| 4,824,287 | A * | 4/1989 | Tracy | 405/36 |
| 5,046,886 | A * | 9/1991 | Muir et al. | 404/25 |
| 5,383,311 | A * | 1/1995 | Strickland | 52/20 |
| 5,386,669 | A * | 2/1995 | Almeida | 52/19 |
| 5,490,419 | A * | 2/1996 | Webb | 73/40.5 R |
| 5,613,806 | A * | 3/1997 | House et al. | 405/150.1 |
| 5,617,679 | A | 4/1997 | Meyers | |
| 5,852,901 | A | 12/1998 | Meyers | |
| 6,047,724 | A | 4/2000 | Nurse, Jr. | |
| 6,457,901 | B1 * | 10/2002 | Sondrup | 404/26 |
| 6,484,451 | B1 | 11/2002 | Gavin | |
| 6,655,093 | B1 | 12/2003 | Gavin | |
| 6,877,281 | B1 * | 4/2005 | Gavin | 52/19 |
| 6,986,227 | B1 * | 1/2006 | Gavin | 52/20 |
| 2003/0145527 | A1 | 8/2003 | Meyers | |
| 2004/0040221 | A1 | 3/2004 | Airheart | |

* cited by examiner

*Primary Examiner*—Jeanette E. Chapman
(74) *Attorney, Agent, or Firm*—Nikolai & Mersereau, P.A.

(57) ABSTRACT

A cover system for septic tanks adapted to be attached to the a septic tank and provide access for repair and maintenance. The assembly includes a base which is embedded into the concrete and provides a seal between the concrete and the base. A pipe member is joined to and sits atop the stationary base member. A wrap made of high density polyethylene surrounds the pipe and covers its corrugations to reduce outside forces upon the pipe. Finally, there is a top cover which is designed to engage the top of the pipe. Additionally, a channel is provided to catch the edge of the pipe and a seal is provided to prevent leakage between the pipe and cover.

9 Claims, 6 Drawing Sheets

COVER SYSTEM FOR SEPTIC TANK

BACKGROUND OF THE INVENTION

I. Field of the Invention

This invention relates generally to septic tank cover systems, and more particularly to septic tank cover systems which are designed to provide access to septic tanks, seal septic tanks from water, and prevent tank leakage.

II. Discussion of the Prior Art

It is well known that access to septic tanks buried underground is periodically needed so that material can be pumped from the tank and maintenance performed. It is important for structures which provide access to the tanks to maintain a water tight environment leading to the buried septic system. The seals for these structures are greatly susceptible to leaks due to their exposure to an outdoor conditions. Frost heaving, forces related to vertical ground movement, and rotational forces due to lateral ground movement can each have a potentially detrimental impact on the integrity of septic tank access structures.

To improve the longevity and durability of access points to septic tanks, it is desirable, as much as possible, to protect the structure from potentially damaging types of ground forces. Various aspects of these problems have been addressed in some previous disclosures although a design specifically suited to properly address these concerns has never been as fully and effectively designed before. For example, in the Meyers. U.S. patent application Pub. No. 2003/0145527, a riser component for an on-site waste system is described which incorporates a riser pan, a cover, and various interconnecting riser elements. The Airhart U.S. Patent Application Pub. No. 2004/0040221 is directed at a molded manhole unit. This application shows a unit with a manifold riser having a beveled riser edge, a riser extension which mates with the manifold riser, a sealing ring, and a riser cap.

The present invention offers important advantages over the prior art due to new concepts included in its design. Specifically, the arrangement of the riser base of the present invention offers several superior features not found in the prior art. These features relate to the ledge and depressions below the ledge that allow secure anchoring of the device into a concrete casting. These advantages also include the uninterrupted surface upon which the pipe member can rest. This surface provides an effective mechanism for sealing the junction between the base and the pipe. The use of corrugated pipe also provides certain advantages in terms of cost, strength, and the ability for one to cut the pipe to length rather than having to buy a specific piece of a specific height. The invention overcomes the problems associated with using such a pipe by providing a novel sealing surface between the pipe and the top cover, a novel sealing arrangement between the riser base and the pipe, and also by providing a sleeve that covers the corrugations in the pipe to prevent the pipe from coming loose from the base due to ground forces. Finally, the manner in which the top cover of the present invention engages the pipe to provide an effective seal that is much more refined and simple than what is shown in the prior art.

SUMMARY OF THE INVENTION

The present invention provides for a cover system for septic tanks which is adapted to be attached to a septic tank and provide a water tight seal access for pumping the contents of the tank and maintaining the tank. The assembly includes a base member which is embedded into the concrete of an underground septic tank providing a seal between the concrete and the base. A pipe member is joined to and sits atop this stationary base member. A wrap made of high density polyethylene surrounds the pipe and covers its corrugations to reduce outside forces upon the pipe. Additionally, there is a top cover which is designed to engage the top of the pipe. Further, a channel is provided on the base to catch the edge of the pipe, novel seals are provided to prevent leakage between the pipe and cover and between the pipe and base. These features work together to form a stable and water tight structure for closing an access opening to a septic tank.

These and other objects, features, and advantages of the present invention will become readily apparent to those skilled in the art through a review of the following detailed description in conjunction with the claims and accompanying drawings in which like numerals in several views refer to the same corresponding parts.

DESCRIPTION OF THE PREFERRED EMBODIMENT

The present invention represents broadly applicable improvements for septic tank design to provide an effective sealed means and stable structure for accessing a septic tank. The embodiments herein are intended to be taken as representative of those in which the invention may be incorporated and are not intended to be limiting.

Figure 1:
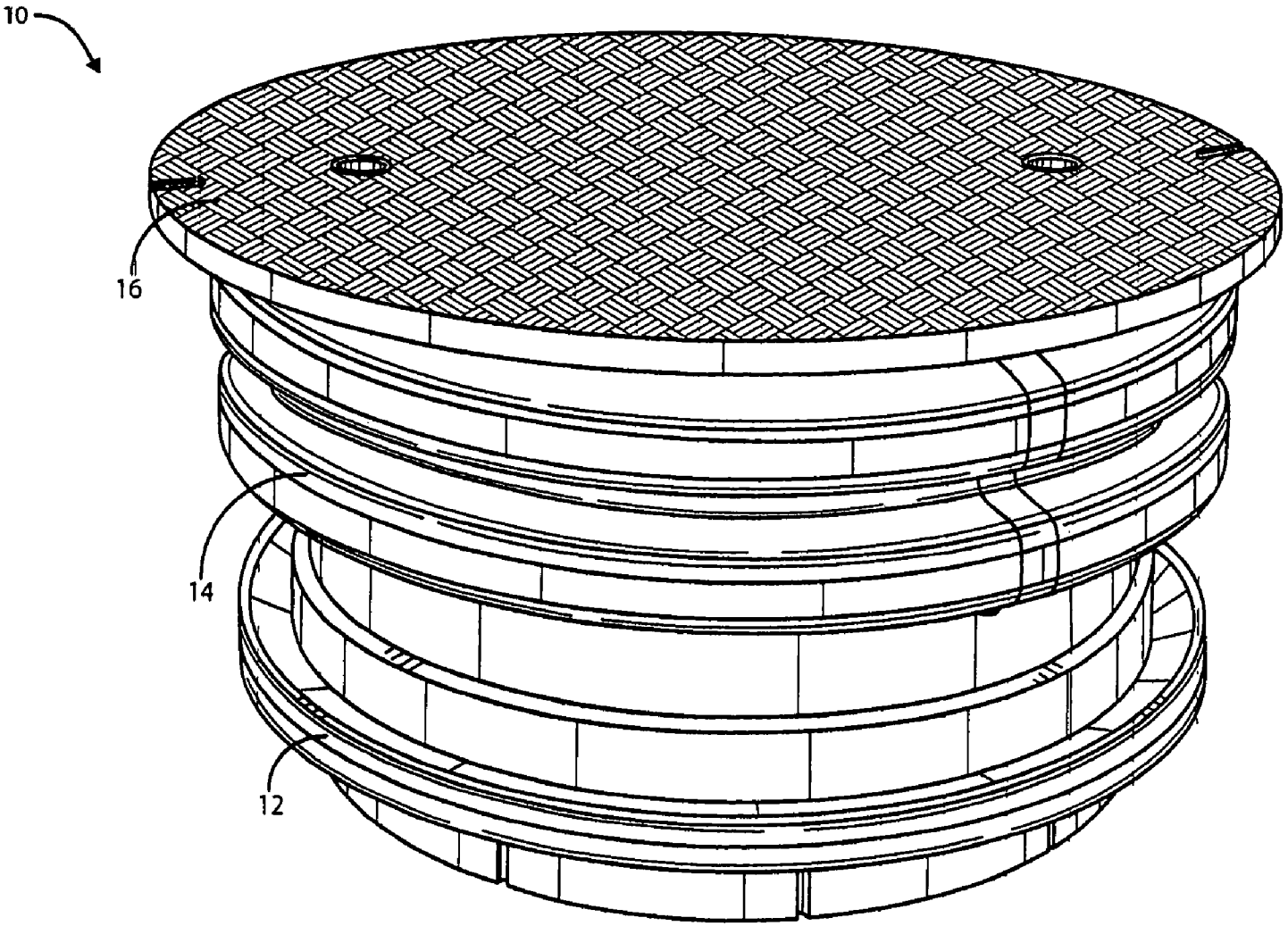
FIG. 1 is a perspective view of the septic cover assembly of the present invention without the outer wrap member.

Referring first to FIG. 1, there is a perspective view of the septic cover assembly shown which would be buried in the ground and cemented in place to provide convenient access to a septic tank from above the ground. The assembly itself is indicated generally by numeral 10 and includes a base 12, a pipe 14, a top cover 16, and a wrap 17 (see FIG. 6). These four components work together to form an invention which create a passageway of structural integrity well-suited for continued and efficient access to a desired septic tank.

Figure 2:
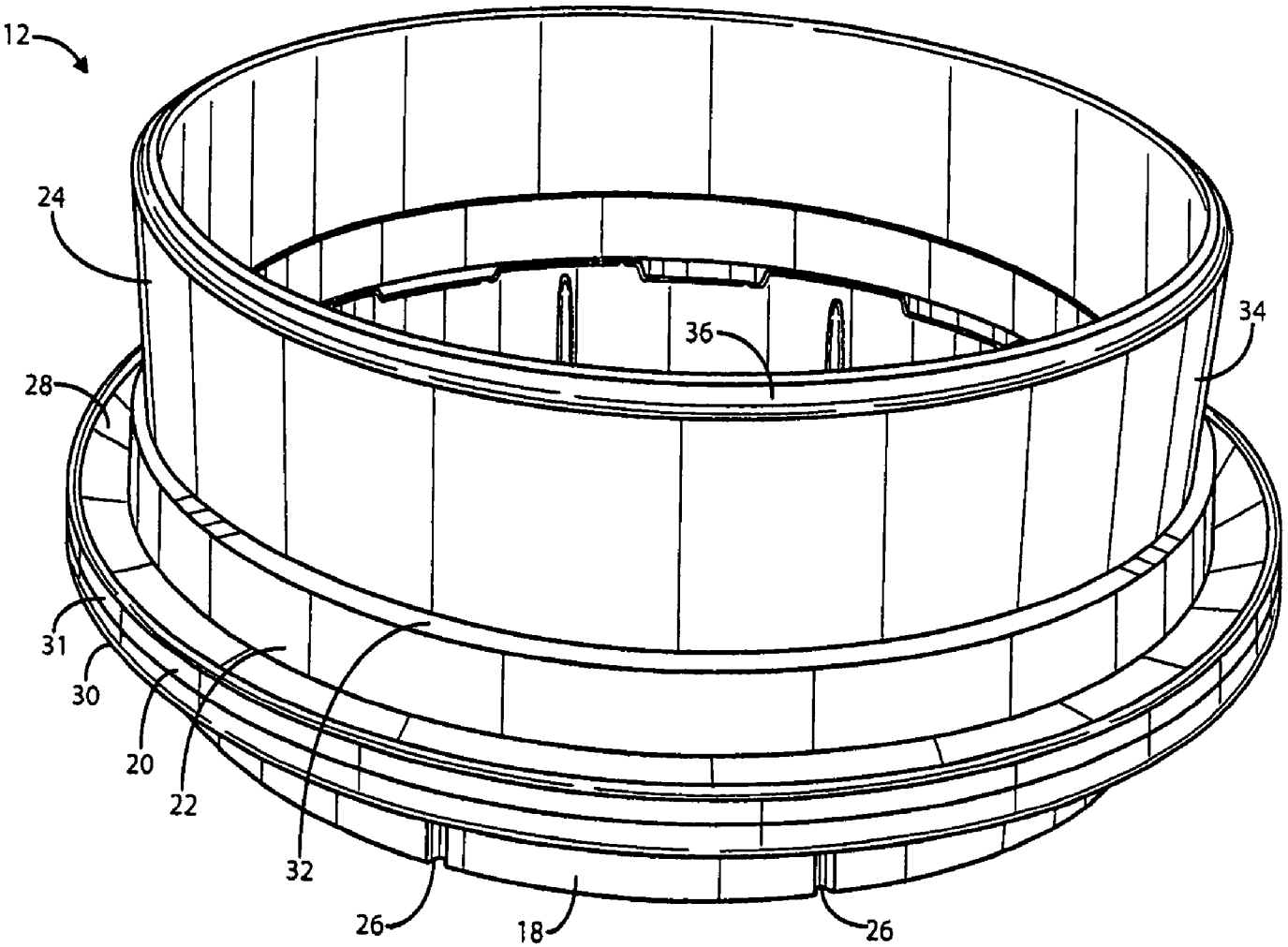
FIG. 2 is a perspective view of the base member of the septic cover assembly.

FIG. 2 discloses a perspective view of the base member 12 of the septic cover assembly allowing for a more detailed examination of its features. Base 12 is a largely cylindrical component which is made of high density polyethylene. It provides a riser coupling which is primarily embedded within concrete and forms a seal between the concrete and the base 12. The riser coupling has a 24-inch opening providing access to the concrete tank in which the base 12 is embedded. Base 12 is comprised of four annular sections 18, 20, 22, and 24. The first annular section 18 is made up of a cylindrical wall containing a plurality of depressions 26 which fill with concrete that encapsulates section 18 of the base member 12 when concrete is poured around it. This arrangement prevents the base member from rotating in the concrete.

Directly above first annular section 18 is a second annular section, ledge 20. Ledge 20 is an annular protrusion which extends radially outward to achieve a diameter substantially larger than the previous diameter of section 18. Ledge 20 has an upper lip 28 and a lower lip 30 that diverge from one another as the annular protrusion extends radially outward. Lip 28 and lip 30 are joined by a vertically disposed outer surface 31. These features prevent the base member from moving up or down with respect to the tank when the ledge 20 is embedded in the concrete. These features of ledge 20 also stiffen the upper structure of the base when the ledge 20 is fully encapsulated by concrete.

Juxtaposed directly above ledge 20 is a third annular section 22. Section 22 has a smaller diameter than ledge 20. The top rim edge 32 of rim 22 marks the height to which concrete is filled when poured around base 12. The rim edge 32 is the feature pipe 14 abuts up against when it is slid onto base 12, as will be later discussed. The edge 32 also assists in providing a water tight seal between the pipe 14 and the base 12.

The last annular section is a riser coupling 24 which has a cylindrical portion 34 of constant diameter and an inwardly projecting lip 36. This section provides a sturdy projection which mates with and is generally covered by pipe 14. It also provides a further barrier to the outside environment.

Figure 3:
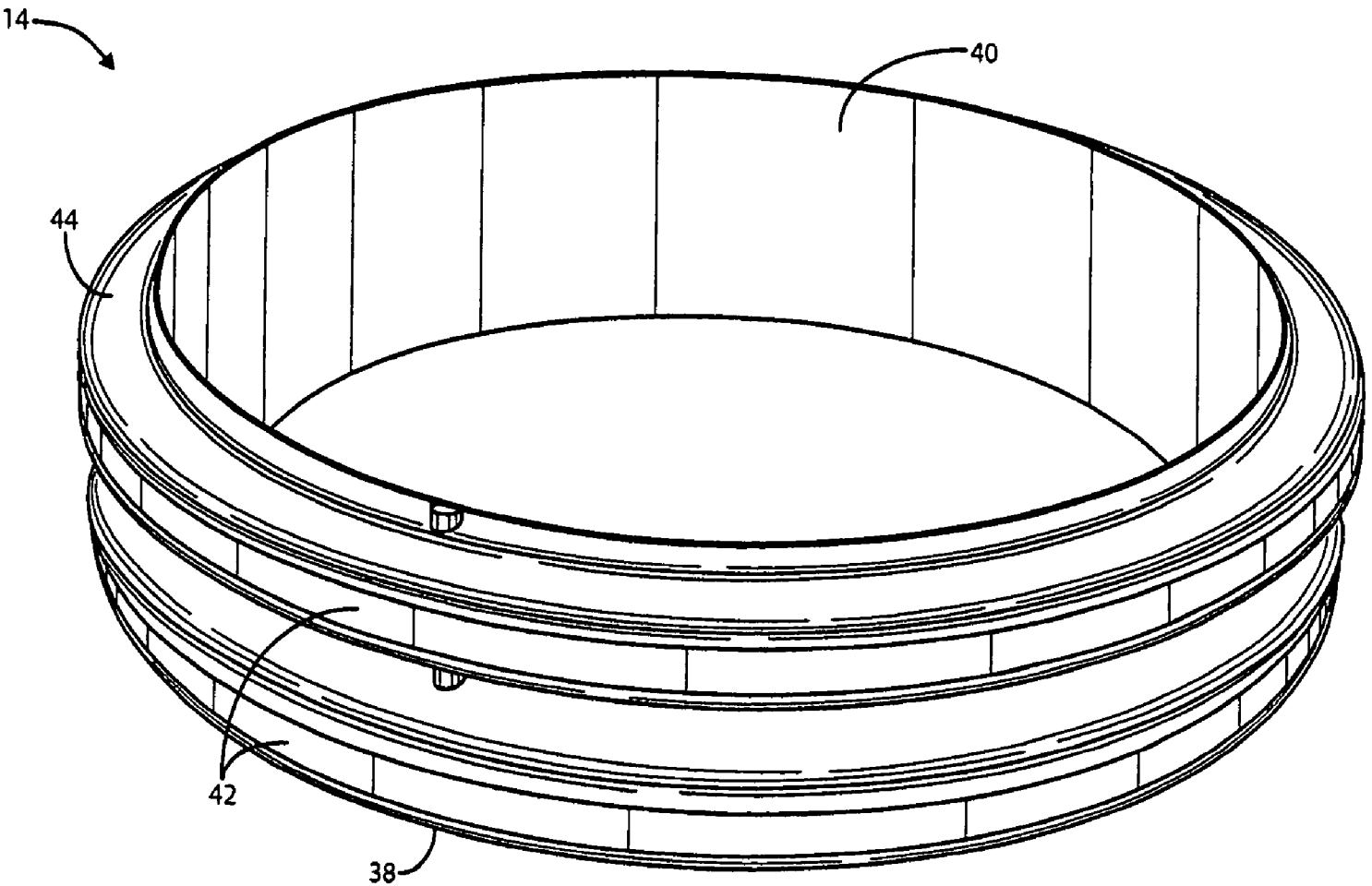
FIG. 3 is a perspective view of the pipe member of the septic cover assembly.

Referring now to FIG. 3, a section of pipe 14 is shown. Pipe 14 is a 24-inch diameter dual wall pipe. The pipe must extend from the base 12 when it is buried underground to above ground level. Thus, dual wall pipe is used that can be cut to length. The length of pipe is typically cut at the time of installation and is made between the corrugations. Only the length of two corrugations of pipe are shown in FIG. 3 although various much longer lengths of pipe containing many more corrugations are common. The pipe 14 is designed to be slid over the top of the riser coupling 24 so that the bottom edge 38 of the pipe 14 will come in contact with the concrete filled to rim edge 32. A seal can be provided at the intersection of the pipe 14 and the concrete to prevent leakage.

Figure 5:
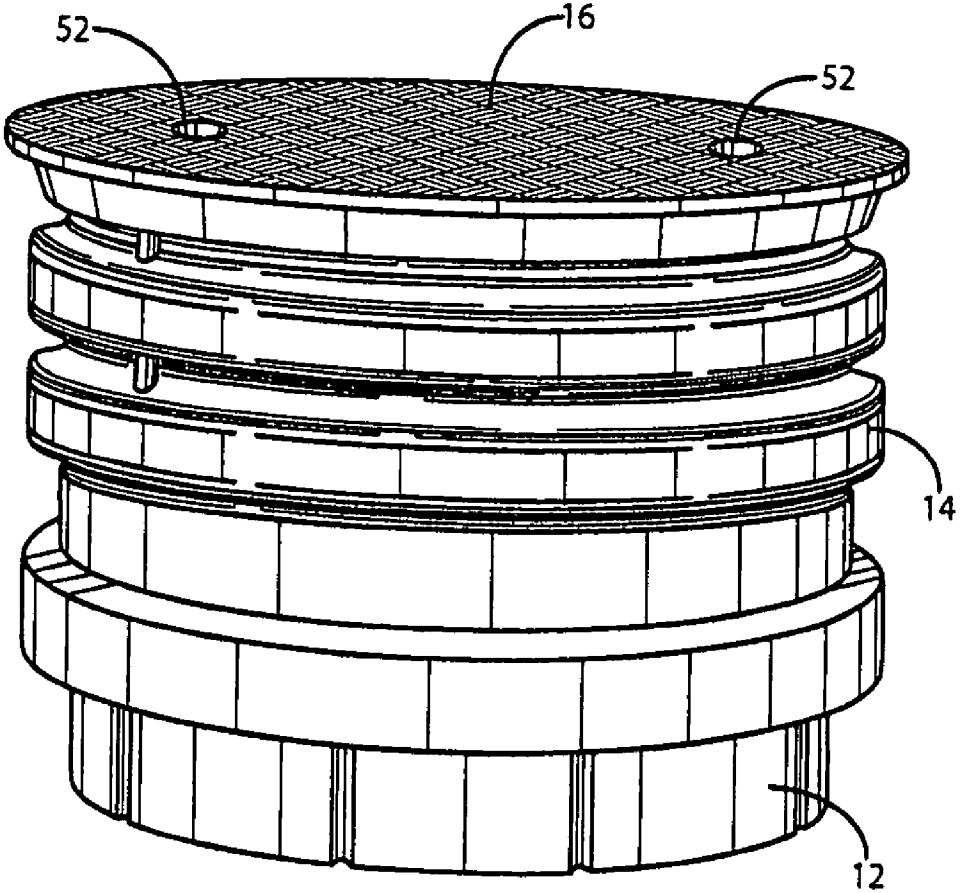
FIG. 5 is a perspective view of the septic cover assembly without the outer wrap member.

Pipe 14 has a smooth inner wall 40 and a corrugated outer wall 42 (i.e. with grooves and ridges, as seen in FIGS. 1, 3 and 5). The corrugations serve to strengthen the pipe. Because this cut-off edge can be non-uniform, it is not a suitable surface for sealing. Therefore, for an effective seal to be made between the pipe 14 and the cover 16, one must be made on the top surface 44 of the top corrugation of the pipe.

Figure 4:
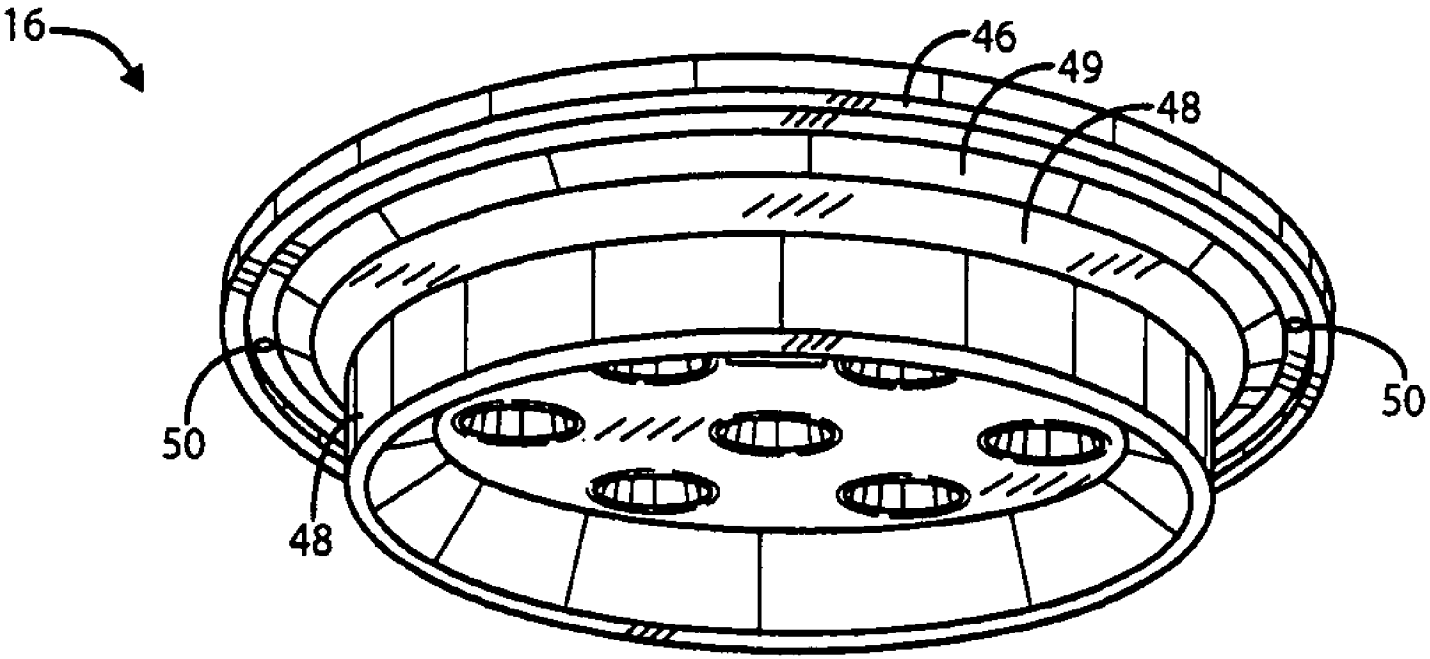
FIG. 4 is a perspective view of the cover member of the septic cover assembly.

FIG. 4 shows the cover 16 of the present invention. The cover generally comprises a flat upper disc component 46 and a lower cylinder component 48 protruding downward from the upper disc 46. The lower cylinder 48 is formed so that it may be inserted snugly within the smooth inner diameter of pipe 14. The upper disc 46 maintains a diameter slightly larger than the corrugated outer wall of the pipe 42 and is the above ground, exposed portion of the cover system 10. In the area surrounding the lower cylinder's protrusion from the upper disc is a slightly raised ring of material 48. This portion of the upper disc 46 is the contact surface corresponding to the seal on the top corrugation surface 44 of pipe 14. The mating established between the cover surface 48 and the seal is water tight. Additionally, there is an inclined surface 49 between the flat outer portion of the disc and the raised material 48. The upper disc 46 of cover 16 contains multiple holes 50 around its periphery which can be used to place a padlock or some other kind of locking mechanism for the prevention of unauthorized access to the septic system. Two cylindrical depressions 52 also exist on the top surface of the cover (see FIG. 5).

FIG. 5 shows the cover 16, pipe 14, and base 12 of the device as they would be in an assembled device, absent the wrap 17. Cylindrical depressions 52 are shown as well. Suitable gaskets or other sealing materials are also provided in the seal ares between the pipe 14 and the concrete and between the relatively flat area of the top corrugation of the pipe 14 and the cover.

Figure 6:
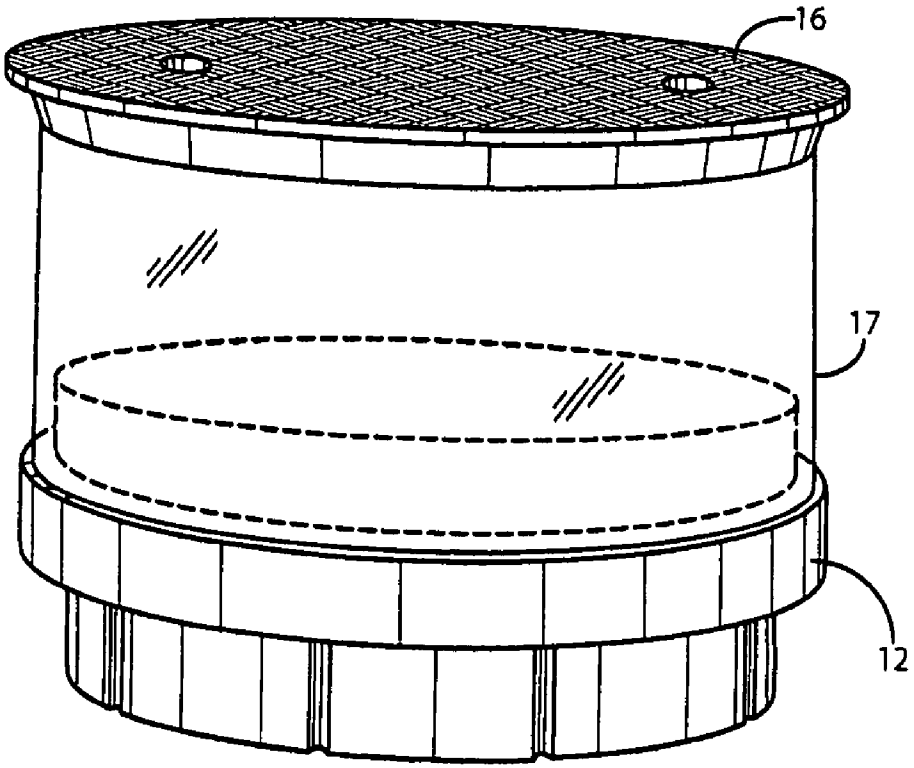
FIG. 6 is a perspective view of the septic cover assembly.

FIG. 6 discloses the final component of the device, wrap 17, added to the assembly. Wrap 17 is made of high density polyethylene material which surrounds the pipe 14. Often the corrugations of pipe 14 present a problem when the pipe is buried in the ground, due to frost or other heaving of the surrounding soil. This can cause the pipe to actually be lifted off of the base 12 due to the forces imparted by changing soil conditions. Wrap 17 is intended to prevent this heaving problem. Wrap 17 surrounds the pipe and covers the corrugations so that forces caused by frost or the like are not applied to bottom portions of the corrugations in the pipe. Such forces are what would otherwise cause the pipe to be lifted from the base. The wrap provides a smooth outer wall surface rather than the corrugations in the pipe.

Now that the details of the mechanical construction of the septic cover assembly 10 of the present invention have been described, consideration will next be given to its mode of operation.

During construction of an underground concrete septic tank, the base member 12 in imbedded into the concrete. The concrete surrounds the outer edge of base member 12 such that concrete, embeds within depressions 26, completely encapsulates ledge 20, and extends to the level of rim edge 32 and top of the concrete. A watertight attachment is thus formed between the tank, the base member 12 and the bottom of pipe 14. Once the concrete hardens, the tank is placed in a hole in the ground. The pipe 14 is cut such that the top of the pipe is approximately even with or slightly above ground level. A seal such as a gasket is positioned so that it surrounds the base member 12. Corrugated pipe 14 is slid over the exposed riser coupling 24 of the base and up against the channel formed by the rim edge 32. Next, a seal is placed along the pipe's top corrugation surface 44 as opposed to the cut edge which tends to be uneven. A cover 16 is then placed within and above pipe 14, engaging against the seal on the top corrugation surface 44 to form a second watertight connection. The cover 16 is locked with a padlock and opened when access is needed for maintenance or repair of the septic tank.

It can be seen, then, that the present invention provides an improved and efficient apparatus for gaining access to a septic tank which functions to effectively seal the tank from water and prevent tank leakage.

This invention has been defined herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A cover system for access and repair of a septic tank comprising, in combination:

(a) a base member affixed to an underground septic tank;

(b) a pipe member, having a smooth inside surface, an outside surface with grooves and ridges, a first end and a second end, said first end attached to the base member, wherein said pipe member is able to be readily cut between its ridges to a length appropriate the septic tank depth;

(c) a cover affixed to said second end of the pipe member and capable of being readily removed;

(d) a seal between the cover and a top surface of the pipe member; and (e) a wrap member surrounding the outside surface of the pipe member.

2. The cover system as in claim 1 where said base member has an annular ledge which is completely embedded in concrete.

3. The cover system as in claim 2 wherein depressions exist in the lower portion of said base member to allow secure anchoring for the device, and to prevent the base member from rotating.

4. The cover system as in claim 3 wherein the base member includes an uninterrupted annular surface upon which the pipe member will rest.

5. The cover system as in claim 1 further including a locking mechanism attached to the cover.

6. A cover system for access and repair of a septic tank comprising, in combination:

(a) a base member adapted to be affixed by cement to an underground septic tank;

(b) a corrugated pipe member, having first and second ends, said first end adapted to attach to the base member;

(c) a cover capable of insertion within the second end of the pipe member and capable of being readily removed;

(d) a seal placed around said second end of the corrugated pipe member such that a water tight connection is capable of being formed between said cover and the uppermost corrugation of the corrugated pipe member;

(e) a wrap member surrounding the outside surface of the pipe member.

7. The cover system as in claim 6 wherein the wrap member is made of high density polyethylene.

8. The cover system as in claim 6 wherein the base member has a plurality of depressions which are filled with cement and prevent the base member from rotating.

9. The cover system as in claim 1 wherein said pipe member is corrugated.

* * * * *